US006063247A

United States Patent [19]

Bergmann et al.

[11] Patent Number: 6,063,247

[45] Date of Patent: May 16, 2000

[54] MODIFIED ELECTROLYTE AND DIAPHRAGM FOR FUSED SALT ELECTROLYSIS

[75] Inventors: Oswald Robert Bergmann; Howard M. Blank, both of Wilmington; Russell Bertrum Diemer, Jr., Hockessin, all of Del.; David Jain, Grand Island; Thomas A. Messing, Ransomville, both of N.Y.; Walter John Simmons, Martinsburg, W. Va.

[73] Assignee: E.I. du Pont de Nemours and Company, Wilmington, Del.

[21] Appl. No.: 09/130,932

[22] Filed: Aug. 7, 1998

[51] Int. Cl.[7] ..... C25C 3/02

[52] U.S. Cl. ..... 204/243.1; 204/244; 204/260

[58] Field of Search ..... 204/244, 243.1, 204/260; 205/408, 409

[56] References Cited

U.S. PATENT DOCUMENTS

| | | | |
|---|---|---|---|
| 2,850,442 | 9/1958 | Cathcart et al. | 204/68 |
| 2,876,181 | 3/1959 | Wood, Jr. | 204/68 |
| 2,940,918 | 6/1960 | Mueller et al. | 204/243 R |
| 3,432,421 | 3/1969 | Cillag et al. | 204/260 X |
| 3,544,443 | 12/1970 | Adaev et al. | 204/245 X |
| 4,092,228 | 5/1978 | Ross | 204/68 |
| 4,584,068 | 4/1986 | Hinrichs et al. | 204/68 |

FOREIGN PATENT DOCUMENTS

WO 97/28295 8/1997 WIPO .

*Primary Examiner*—Donald R. Valentine

[57] ABSTRACT

Lithium chloride improves electrolytic cell efficiency and performance when included in the electrolyte. Self-aligning cell diaphragms improve cell efficiency and reduce maintenance.

8 Claims, 3 Drawing Sheets

MODIFIED ELECTROLYTE AND DIAPHRAGM FOR FUSED SALT ELECTROLYSIS

FIELD OF THE INVENTION

This invention relates to an electrolytic cell for the electrolysis of fused alkali chloride salts to produce alkali metals such as sodium and lithium.

DESCRIPTION OF THE RELATED ART

Electrolytic cells for the electrolysis of fused alkali chloride salts are used widely in industry to produce alkali metals, such as sodium and lithium, that are difficult to reduce to a metallic state. A major cost for operating these cells is the cost of electric power. Since the early 1970's, the cost of electric power has increased sharply. Development of more energy-efficient electrolysis processes, therefore, has become increasingly important.

The electrolytic recovery of sodium metal is commercially carried out via non-aqueous molten chloride salt electrolysis. While the discussion below concentrates on sodium manufacture, the features relating to cell design and mechanical operation also apply to manufacture of lithium and other alkali metals.

Most industrial installations for molten salt electrolysis of sodium employ the Downs cell design to carry out the process, originally disclosed in U.S. Pat. No. 1,501,756. A detailed description of this cell is given in Ullmann's Encyclopedia of Industrial Chemistry, $5^{th}$ Ed., Vol. A24, VCH Verlagsgesellschaft, Germany, pp. 284–288 (1993). A typical industrial cell of this type is shown in FIG. 1.

The electrolyte typically used is a mixture of sodium chloride with other salts to lower the melt temperature. A cell operating temperature of about 600 degrees C is ordinarily employed. Ullmann lists a suitable mixture as 28 wt % NaCl, 25 wt % CaCl2 and 47 t % BaCl2. U.S. Pat. No. 2,850,442 discloses a mixture of about 26 wt % NaCl, 60 wt % SrCl2, and 14 wt % BaCl2. Adaev et al, Zh. Prikl. Khim. (Leningrad) (1973), Vol.46, No.1, pp 191–2 disclose the electrolysis of mixtures of 27 to 29 wt % NaCl, 64 to 67 wt % BaCl2 and 9 to 4 wt % LiCl at temperatures above 650° C. The literature discloses numerous other ternary mixtures. The choice of mixture depends on such factors as the melting temperature of the mixture, its electrical conductivity, the desired purity of the resulting sodium, and the possible deposition of the salts at various points in the apparatus due to differences in solubility at the lower temperatures encountered in some parts of the sodium cell. These factors affect operability of the cell, how often the cell must be shut down for repairs, current efficiency and productivity of the cell, and in general what is referred to in the trade as the "health" of the cell.

A modern Downs cell typically contains four graphite carbon rods that serve as anodes. Each anode is surrounded by a concentric steel cylinder that serves as a cathode. In operation, sodium is deposited on the inside surface of the steel cathodes and chlorine gas is liberated at the graphite anodes. Typically, in a cell with four pairs of electrodes, the chlorine is collected in four shafts from the anodes while the sodium is collected in a single compartment covering all four cathodes.

A hydraulically permeable diaphragm is used to separate the cathode and anode compartments to prevent back-mixing and reaction of the sodium and chlorine. It typically is made of steel mesh, and has a relatively short life of about two months because it corrodes and plugs with debris. When the diaphragm develops any major holes, it must be replaced because the holes lead to back-mixing and reaction of the sodium and chlorine, in turn reducing current efficiency and energy efficiency. Replacement of the diaphragm is a labor-intensive and costly step.

Current diaphragm designs have a number of shortcomings. One shortcoming is that the diaphragms typically are rigidly attached to the sodium collector by a steel ring bolted to the collector. Attachment of the diaphragm to the sodium collector is accomplished by a laborious operation in a specially designed "pit." Following the attachment step, the diaphragm is transported to the cell and lowered into place. Because the bolted design is rigid, and because there are slight mechanical variations from cell-to-cell, this procedure rarely achieves perfect alignment between the new diaphragm and the electrodes in the cell along the entire cell length. Imperfect alignment causes partial shorting between anodes and cathodes, reducing current efficiency of the cell.

Improved current efficiency is a major area for potential power savings. While the efficiency of an electrolytic process theoretically could be above 99%, most commercial molten salt sodium cells operate at relatively low current efficiencies. Ullmann's Encyclopedia, for example, lists a typical current efficiency of 80 to 90% (p. 287).

Another important area for power savings is to decrease the voltage drop across the cell. Typically the voltage drop across the electrolyte-filled space between the cathode and the anode accounts for about 40% of the electric energy required to run a sodium cell. Reduction of the electrical resistivity of the molten electrolyte would result in important energy savings for cell operation. However, to maintain smooth operation, any new electrolyte composition must not increase the melting temperature of the mixture or the tendency of associated metal salts to precipitate out of solution, and must produce a sodium metal of acceptable purity. Preferably, a new electrolyte composition also should improve the operability and "health" of the cell.

SUMMARY OF THE INVENTION

The present invention provides an electrolytic cell for the production of chlorine and an alkali metal from a fused chloride electrolyte having at least one graphite rod anode, a concentric cylindrical cathode surrounding each anode, a rigid cylindrical diaphragm positioned between said anode and cathode, and insulated aligning means that engage the diaphragm and the anode or cathode to concentrically align said diaphragm as it is placed in position (i.e., the diaphragm is self-aligning). In a preferred diaphragm the aligning means are sets of insulating rollers, conveniently mounted on the outer surface of the diaphragm to engage the inner surface of the cathode as the diaphragm is inserted into position.

In one embodiment, the self-aligning diaphragm has a buoyancy chamber that causes the diaphragm assembly to float in the electrolyte. In another embodiment, the self-aligning diaphragm mechanically locks into position by a locking mechanism mounted on top of the diaphragm that engages a sodium collector structure mounted above the cathode.

The invention also provides the following electrolytic compositions for the production of chlorine and sodium:

(a) about 20 to 40 wt % NaCl, 30 to 50 wt % $BaCl_2$, 15 to 30 wt % $CaCl_2$ and 0.2 to 13.0 wt % LiCl, (b) about 20 to 40 wt % NaCl, 5 to 15 wt % $BaCl_2$, 50 to 70 wt % $SrCl_2$ and 1.0 to 13.0 wt % LiCl, and, (c) about 20 to 40 wt % NaCl, 50 to 80 wt % $SrCl_2$ and 0.2 to 13.0 wt % LiCl.

DETAILED DESCRIPTION OF THE INVENTION

This invention provides several substantial improvements to the mechanical and electrolytic elements of an electrolytic cell for the production of molten alkali metal and gaseous chlorine by the electrolysis of fused chloride salts. While the mechanical and electrolytic improvements are discussed separately one or more of these improvements may be incorporated in a single design of an improved electrolysis cell. While the description is given in terms of electrolyzing sodium chloride, the mechanical improvements of the improved cell may also be used for the electrolysis of lithium and other alkali metals.

Downs Cell

Figure 1A:
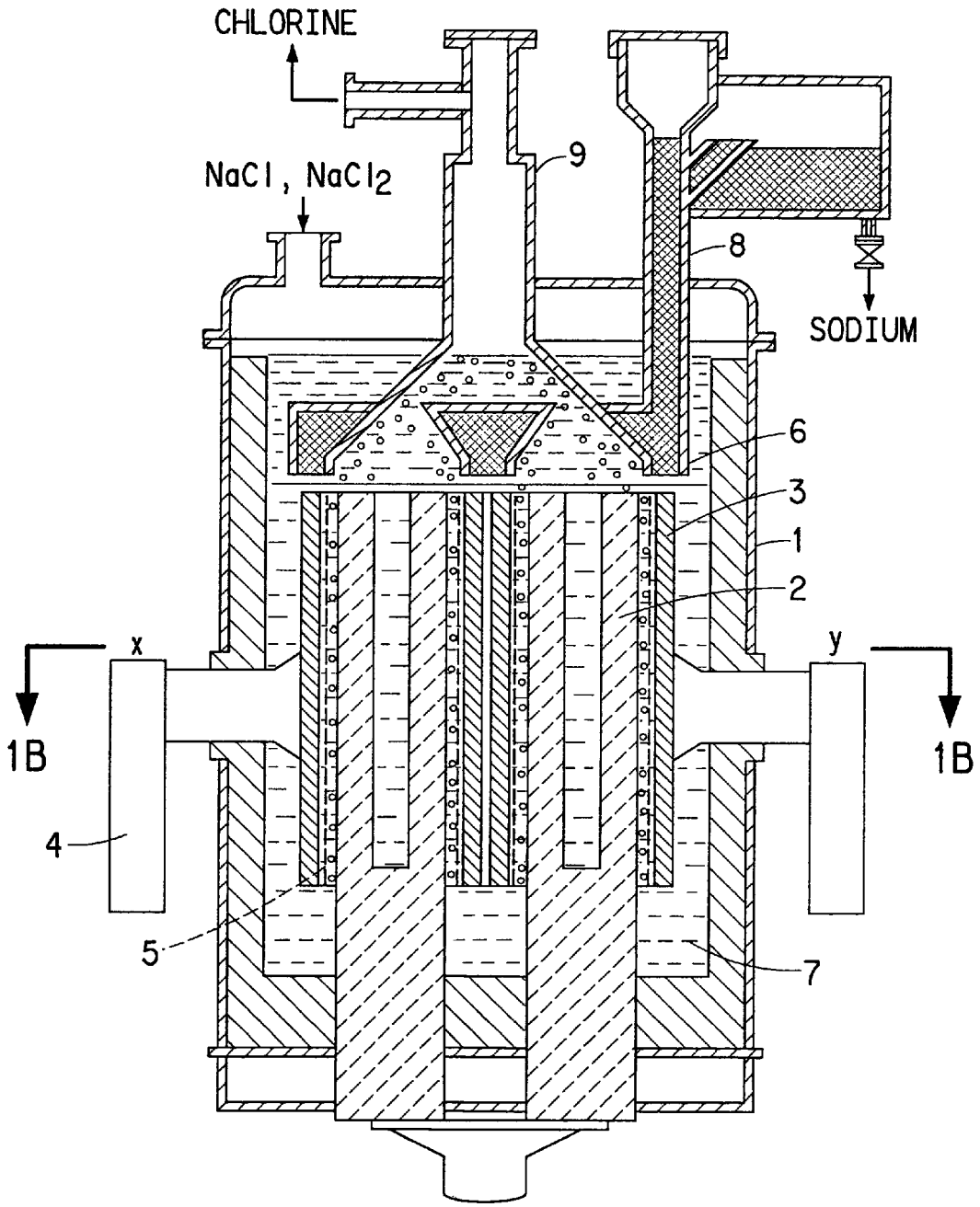
FIG. 1A (PRIOR ART)
FIGS. 1A and 1B are vertical and horizontal cross-sections, respectively, of a typical Downs cell having four sets of electrodes.
Figure 1B:
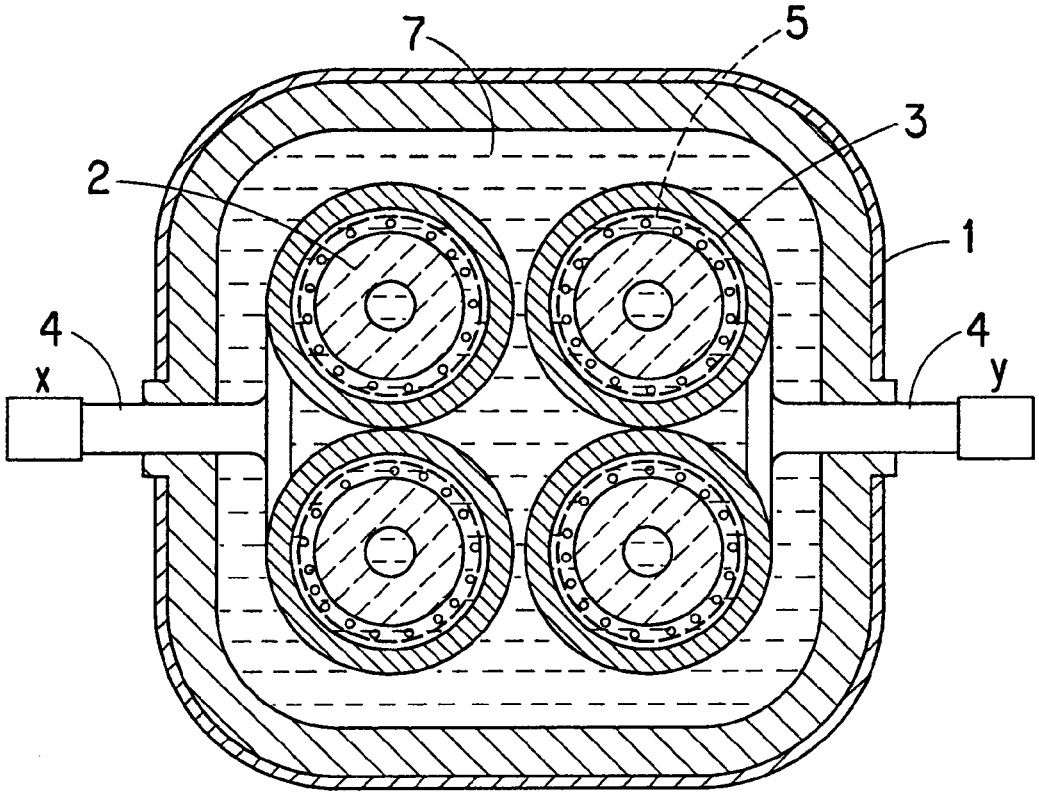
FIG. 1B (PRIOR ART)

FIGS. 1A and 1B, respectively, illustrate vertical and horizontal cross-sections of a typical Downs-type cell having four sets of electrodes. The cell has a cylindrical brick-lined, steel casing 1. Cylindrical graphite anodes 2 project upwardly through the bottom of the steel casing. The cathodes 3 are steel cylinders having two diametrically opposed steel arms 4 that project outside the cell casing to serve as electric terminals. Cylindrical steel screen mesh diaphragms 5 are suspended about midway in the annular space between the anodes and the cathodes. Annular collector ring 6 collects molten metal that rises in the fused electrolyte 7 from the cathodes. Outlet tube 8 carries the metal collected in the collector ring to the outside of the cell. Gas dome 9 carries gaseous anodic products formed by the electrolysis. Elements 5, 6, 8 and 9 are supported in the cell by means not shown, typically by rigid means such as conventional bolts, fasteners or welding.

A steel-mesh screen currently is employed as a diaphragm to separate the cathode and anode compartments. The diaphragm prevents back-mixing and reaction of the cathodically produced alkali metal and anodically produced chlorine. The relatively short life of the diaphragm, combined with the labor-intensive method of replacing and aligning them, is a major cost factor in the operation of the Downs cell. In addition, such diaphragms are of limited effectiveness, in part due to alignment deficiencies, with groups of cells typically only achieving overall current efficiencies in the range of 80% to 90%.

Self-Aligning Diaphragm

The diaphragm designs of the current invention overcome these limitations of the prior art by providing a self-aligning diaphragm. By "self-aligning" it is meant that the diaphragm aligns itself concentric with, and at a predetermined distance from, the cathode and anode as the diaphragm is inserted into place.

Figure 2:
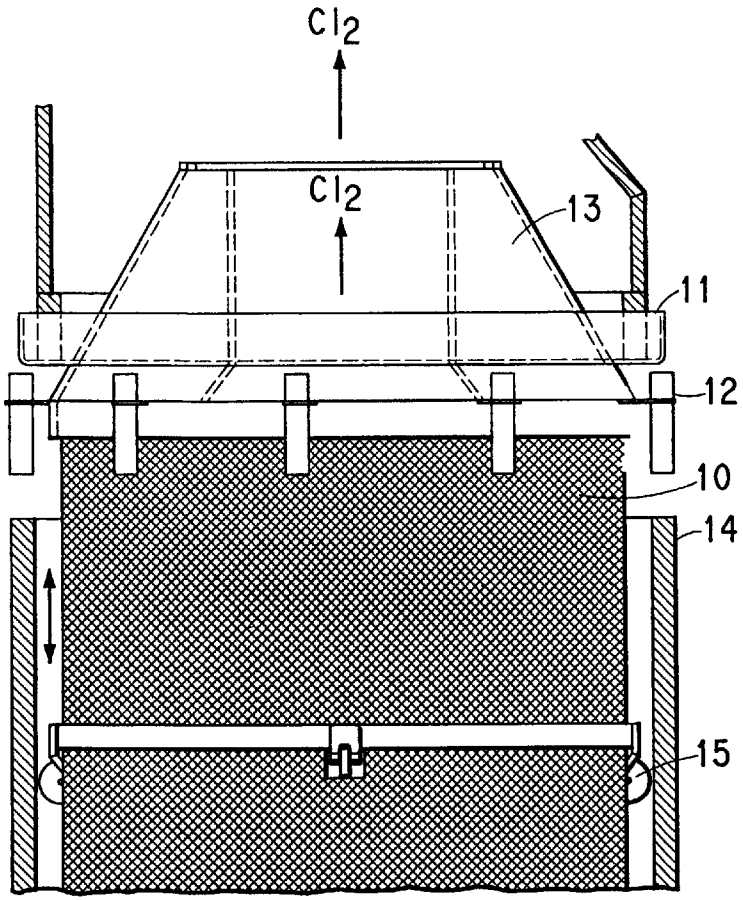
FIG. 2 illustrates one embodiment of the self-aligning diaphragm of this invention.

FIG. 2 illustrates one embodiment of the self-aligning diaphragm provided by this invention. The diaphragm 10 is made of conventional screening or slotted materials such as disclosed in prior art, but has the following features that make it self-aligning. Instead of a rigid, bolted connection between the diaphragm and the sodium collector 11, the diaphragm floats in the electrolyte and rests against the bottom of the sodium collector, separated from it electrically by a number of mechanically rugged electrical insulator supports 12, such as a modified spark plug, fastened at intervals around the top of the diaphragm. These insulator supports are so fastened that their bottoms will rest on the cathode 14 when the floating diaphragm is in its lowest position. Also fastened to the top of the diaphragm is a buoyancy chamber 13, a hat-like device containing small bleed holes in the top. The volume of the buoyancy chamber is sized so that the diaphragm will rest against the sodium collector in normal operation, buoyed up by the upflowing chlorine gas collected in the chamber. When the electricity to the cell is reduced or shut off completely, chlorine slowly escapes through the bleed holes, causing the floating diaphragm to move downward or sink to the point that the insulator supports rest on the top surface of the cathode. This movable diaphragm has at least two sets of insulating roller-spacers 15, one near the bottom of the diaphragm and one set higher up on the diaphragm, to provide the self-aligning feature. Only the upper set is shown. The clearance between the roller-spacers and the cathode wall is sufficient to allow the diaphragm assembly to freely move up and down, but not so large as to allow mis-alignment that would unnecessary increase in the path for current flow, which would increase the cell voltage required for operation.

In operation, the buoyancy chamber fills with chlorine gas evolved at the anode, the remaining amount of chlorine bypassing the buoyancy chamber and going to the collection system. The chlorine in the buoyancy chamber floats the entire diaphragm assembly upwards until the upper part of the insulator supports rests against the sodium collector. Thus, need for a bolted or rigid connection to the collector is avoided, eliminating the costly "pit" operation required for repair and replacement by the conventional design.

When the cell current is turned off, chlorine evolution at the anode stops and the chlorine in the buoyancy chamber slowly escapes through the small bleed holes. The chamber gradually fills with molten electrolyte and loses its buoyancy, causing the diaphragm assembly to sink until the insulator supports rest on the top surface of the cathode. This up-and-down motion can be deliberately achieved by turning the cell current on and off. The up-and-down motion is very useful in breaking and shearing off calcium dendrites that often form during cell operation, causing partial shorts, arcing and loss of current efficiency. The sets of insulating roller-spacers keep the diaphragm centered and prevent it from shorting against the electrodes during this operation. Means other than insulated rollers may be employed to self-align the diaphragm, and the means may be mounted on the diaphragm, cathode, anode, or other structural element of the cell.

Figure 3:
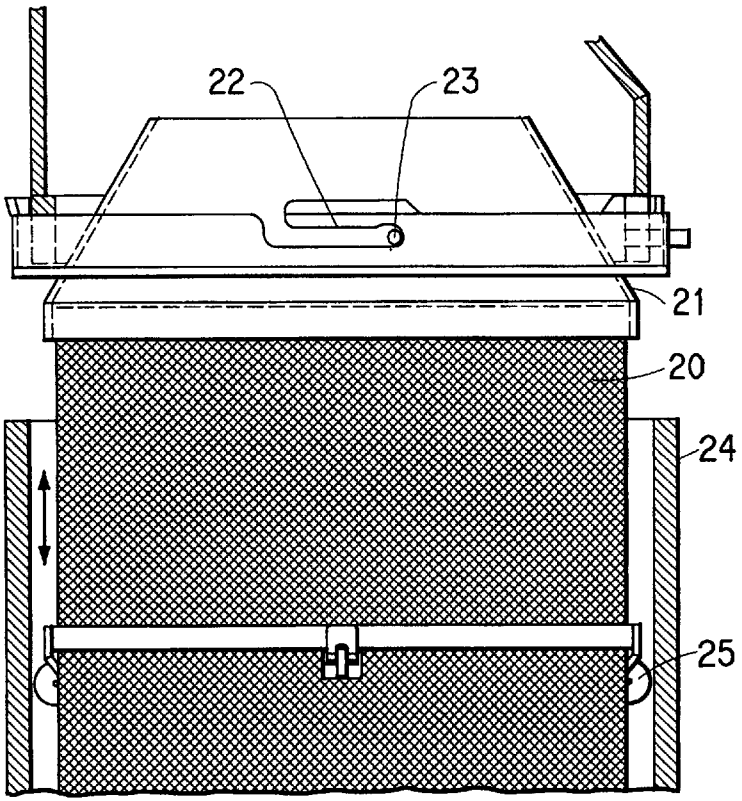
FIG. 3 illustrates a second embodiment of the self-aligning diaphragm of this invention.

FIG. 3 illustrates a second embodiment of the self-aligning diaphragm of this invention. As in the first embodiment, the diaphragm 20 is made of conventional screening or slotted materials. The diaphragm has a metal piece 21 rigidly fastened to its top portion that contains a number of L-shaped slots, of which slot 22 is shown in side view. Fitted into each slot is a rod, of which rod 23 is shown in end view. These rods are rigidly fastened to the sodium collector, but are not fastened to the diaphragm. The slots and rods are positioned such that the diaphragm assembly can be inserted from below the sodium collector, with the vertical portion of each slot in line with each matching rod, then moved upward and rotated (as if screwing a glass jar onto its lid) to the end of the slot's travel. A small upward widening of the slot at its end locks the diaphragm in position within the cathode 24. The clearance between the widened slot locks and the rods is sufficient for a slight sidewards free movement of the diaphragm. In order for this slightly moveable diaphragm to be self-aligning, it has at least two sets of insulating roller-spacers 25, one near the bottom of the diaphragm and one set higher up on the diaphragm to provide the self-aligning feature of this design. Only the upper set is shown in this Figure. The clearance between the roller-spacers and the cathode wall is sufficient to allow the diaphragm to be rotated into position, but not so large as to allow mis-alignment that would unnecessary increase the path for current flow, which would increase cell voltage required for operation. Means other than insulated rollers may be employed to self-align the diaphragm, and the means may be mounted on the diaphragm, cathode, anode, or other structural element of the cell.

As in the previous diaphragm embodiment, there is no need for a bolted or rigid connection between the diaphragm and the sodium collector, thus eliminating the costly "pit" operation required for repair and replacement by the conventional design.

The insulator supports and the insulating roller spacers for the above diaphragms can be made of any insulating materials which have adequate strength and mechanical properties at bath temperatures and are insoluble in the molten electrolyte, such as silicon nitride ($Si_3N_4$), alumina ($Al_2O_3$) and other materials known to those skilled in the art. The axles on the rollers can be any rigid material which is suitable for the bath environment, preferably a metal such as steel.

While the invention has been described in detail with respect to a preferred embodiment wherein insulated rollers are employed as the aligning means, it will be appreciated that equivalent means may be selected to space the diaphragm concentrically with the anode and cathode. For example, rigid spacing means could be mounted on the inner surface of the cathode. Likewise, means other than the buoyancy chamber illustrated in FIG. 2 may be employed to cause the membrane to float in the electrolyte, and means other than the locking slots and pins illustrated in FIG. 3 may be employed to lock the membrane in position.

Electrolyte Composition

The electrolyte composition used in a sodium cell influences operability of the cell in several ways. Not only is the melting temperature of the overall composition important, but also the variation in melting temperature as the ratio of ingredient changes. Due to poor cell circulation, both electrolyte composition and temperature vary in different parts of the cell. Typically, the bottom of the cell is cooler than the rest, creating problems due to deposition of electrolyte ingredients and impurities. These depositions cause productivity and current efficiency of the cell to deteriorate, requiring the cell to be shut down for repair and/or replacement of the diaphragm. Other problems may occur, causing a phenomenon referred to in the trade as "smoking." The smoothness of operation of a cell, while maintaining good productivity, is referred to as the "health" of the cell. Correspondingly, cells with poor operability are referred to as "sick" cells. For the health of a cell, it is important that the electrolyte have a wide ratio of compositions that remain entirely molten over a wide range of temperatures. The ability of a substance to promote free movement of the fused electrolyte salts over a range of temperatures is referred to herein as its "fluxing" ability.

Another important character of the electrolyte is its conductivity. The voltage drop across the electrolyte-filled space between cathode and anode for a typical NaCl—$CaCl_2$—$BaCl_2$ electrolyte composition is almost 3 volts, accounting for about 40% of the electric energy required to run a sodium cell. Other typical electrolytes have similar voltage drops. Any reduction in the electrical resistivity of the molten electrolyte would result in important energy savings for cell operation. It is known that lithium chloride (LiCl) has substantially lower electrical resistivity than the ingredients in the above typical mixtures. Previous attempts to use lithium chloride as an electrolyte component were unacceptable, however, because of the high lithium content of the sodium produced or various other operating problems. These attempts did not include the specific combination of ingredients of this invention, in which small amounts of lithium chloride are added as an extra ingredient to existing commercially useful binary and ternary electrolyte mixtures, converting them to ternary and quaternary mixtures, respectively.

In accordance with the invention, it has been found that the presence less than 1%, and as little as 0.2%, of LiCl in the ternary and quaternary electrolyte mixtures is advantageous. Not only is current efficiency improved, but general health of the cell as well. The cell operates smoother, with less smoking and spurious electrolyte freeze-ups. In addition, the presence of even small quantities of lithium chloride can result in 30% to 100% longer diaphragm useful life, reducing the amount of cell down-time for costly replacement of the diaphragm.

A series of experiments were conducted on the effect of LiCl addition on melting temperature of a typical calcium chloride-based electrolyte (26 wt % NaCl, 48 wt % BaCl2, 26 wt % CaCl2). The effect of small LiCl additions to the bath was studied. Addition of LiCl transforms this ternary system into a quaternary system for which no published data is available. These compositions were subjected to thermal analysis tests (DSC/Differential Scanning Calorimetry) to determine their melting temperatures, by which we mean the temperature at which all the material is molten. The results were as follows.

TABLE 1

| | Calc. Composition, wt % | | | | Melting Temp., |
|---|---|---|---|---|---|
| Additions | NaCl | BaCl2 | CaCl2 | LiCl | ° C. |
| Control (no LiCl) | 26.0 | 48.0 | 26.0 | 0.0 | 575, 579 |
| 1% LiCl addition | 25.7 | 47.5 | 25.7 | 1.0 | 566, 568 |
| 2% LiCl addition | 25.5 | 47.1 | 25.5 | 2.0 | 563, 564 |
| 5% LiCl addition | 24.7 | 45.7 | 24.7 | 4.8 | 553, 554 |
| 10% LiCl addition | 23.6 | 43.6 | 23.6 | 9.1 | 514, 499 |
| 20% LiCl addition | 21.7 | 40.0 | 21.7 | 16.7 | 480, 482 |
| 40% LiCl addition | 18.6 | 34.2 | 18.6 | 28.6 | 520 |

The experimental results obtained for this system showed that LiCl additions, even in quite small amounts, will significantly lower the melting temperature of electrolyte compositions and thereby improve operability of the sodium cells.

The strongest effect on lowering melting temperature is between 0.2% to 10% LiCl addition. The rise in temperature between 20% and 40% LiCl indicates the presence of a eutectic within this composition range for this quaternary mixture. A range of 0.2 to 15 wt % addition of LiCl is preferred for reasons of economy, corresponding to a composition of about 20 to 40 wt % NaCl; 30 to 50 wt % $BaCl_2$; 15 to 30 wt % $CaCl_2$; and 0.2 to 13.0 wt % LiCl.

A similar series of experiments addressed the effect of relatively small LiCl additions on the melting temperature of a ternary strontium chloride-based electrolyte for sodium manufacture (26 wt % NaCl, 12 wt % $BaCl_2$, 62 wt % $SrCl_2$) Addition of LiCl transforms this ternary system into a quaternary system for which no published data is available. Electrolyte compositions were prepared containing 5 wt % and 10 wt % of LiCl added to the above strontium-based bath. These compositions were subjected to thermal analysis tests as before to determine their melting temperatures. The results were as follows.

TABLE 2

| | Calc. Composition, wt % | | | | Melting Temp., |
|---|---|---|---|---|---|
| Additions | NaCl | BaCl2 | SrCl2 | LiCl | ° C. |
| Control (no LiCl) | 26.0 | 12.0 | 62.0 | 0.0 | 545 |
| 5% LiCl addition | 24.7 | 11.4 | 59.0 | 4.8 | 515 |
| 10% LiCl addition | 23.6 | 10.9 | 56.4 | 9.1 | 462 |

It is seen from the above data that even small additions of LiCl will significantly lower the melting temperature of the strontium bath, and thereby substantially broaden the operability of such a bath by preventing freeze-ups and similar problems. A range of 0.2 to 15 wt % addition of LiCl is preferred for reasons of economy, corresponding to a composition of about 20 to 40 wt % NaCl; 5 to 15 wt % $BaCl_2$; 50 to 70 wt % $SrCl_2$; and 0.2 to 13.0 wt % LiCl.

Similar experiments were conducted on the binary system of NaCl and $SrCl_2$. Published data show a eutectic composition of 30 wt % NaCl and 70 wt % $SrCl_2$ with a eutectic melting temperature of about 570° C. The melting temperature rises sharply with small changes in composition, allowing only a 15% wide range of compositions before the melting temperature would exceed a typical cell operating temperature of 600° C. By adding 11 wt % of LiCl to the above eutectic composition, the following results were obtained.

TABLE 3

| | Calc. Composition, wt % | | | |
|---|---|---|---|---|
| Additions | NaCl | SrCl2 | LiCl | Melting Temp., ° C. |
| Control (no LiCl) | 30.0 | 70.0 | 0.0 | 570 |
| 11% LiCl addition | 27.0 | 63.1 | 9.9 | 479 |

The above results show that even small additions of LiCl have a powerful fluxing effect on the NaCl/$SrCl_2$ binary system. That is, small additions of LiCl give a much broader range of melting temperatures, thereby improving operability at the typical 600° C. operating temperature of the sodium cells. A range of 0.2 to 15 wt % addition of LiCl is preferred f or reasons of economy, corresponding to a composition of about 20 to 40 wt % NaCl; 50 to 80 wt % $SrCl_2$; and 0.2 to 13.0 wt % $LiCl_2$.

To determine if relatively small percentages of lithium chloride would yield a sodium cell product with acceptable purity, laboratory experiments were designed and carried out to determine the degree of lithium pick-up by sodium metal in contact with lithium chloride-containing electrolyte at 600° C. under non-equilibrium conditions (that is, with no stirring). The conditions chosen approximately various simulated conditions in the electrolytic cell and covered a wide range of exposure times, ranging from the few seconds time required for sodium droplets to rise through the electrolyte bath to the several hours when a thick layer of sodium metal inside the collector is in quiet contact with, and floats on, molten electrolyte. The electrolyte in these experiments contained (by weight) 4.8% LiCl; 24.7% NaCl; 24.7% $CaCl_2$; and 45.7% $BaCl_2$. Results of this preliminary study are shown in Table 4.

TABLE 4

Lithium Pick-up by Sodium Metal

| Exposure Time | Lithium Content of Sodium Metal |
|---|---|
| 1 minute | 0.2 ppm |
| 10 minutes | 3.5 ppm |
| 20 minutes | 1.6 ppm |
| 240 minutes (4 hours) | 0.6 ppm |

These tests show that, although there is considerable scatter in these data, the absolute level of lithium pick-up by sodium metal under these conditions is minimal.

It is also important to know if Li will co-deposit with Na at the electrode. Such co-deposition would be highly undesirable and negate use of Li-containing electrolytes. In order to estimate the thermo-dynamic driving force for co-deposition of Li with Na for small LiCl additions, the EMF gaps at 600° C. between Na and Li was calculated for the above strontium-based and calcium-based electrolyte compositions. The larger the EMF gap between the Na and the less noble Li, the less will be the tendency for the Li to co-deposit.

For a 5% addition of LiCl to the calcium-based electrolyte, the EMF gap increases from about 0.1 volts based on the standard EMFs between Na and Li at 600° C. to about 0.2 volts. This is a big increase in the EMF gap, and means that at low LiCl concentrations the driving force is for Na deposition without Li deposition, a favorable result. Similar results were obtained for the strontium-based bath.

Using literature data on the electrical conductance for LiCl, NaCl, $BaCl_2$ and $CaCl_2$, it is estimated that the cell voltage change for a 10% LiCl-containing bath based on the above typical calcium chloride-based electrolyte would be about a 0.5 volts to 0.8 volts reduction, corresponding to about 7% to 11% power savings.

Plant tests confirmed the above preliminary information. Even at amounts of LiCl addition as low as 0.2 to 5 wt % resulted in noticeable increases in current efficiency. In the calcium chloride based electrolyte, a 0.2 to 3 wt % addition of LiCl showed about 2% higher current efficiency. In addition, a more uniform temperature distribution was noted throughout the cell, a 10° C. variation from top to bottom versus about a 30° C. variation without LiCl addition, and therefore more trouble-free operation of the cell, i.e., fewer upsets, "sickness" or "smoking" of the cell and less spurious freezeups near the bottom of the cell and in other locations. Over time, this will result in higher average energy efficiency and less maintenance and operating labor requirements. That is, the addition of LiCl to typical sodium electrolyte compositions surprisingly gives better cell operability.

What is claimed is:

1. An electrolytic cell for the production of chlorine and an alkali metal from a fused chloride electrolyte comprising at least one graphite rod anode, a concentric cylindrical cathode surrounding each anode, a rigid cylindrical diaphragm positioned between said anode and cathode, and self-aligning means that align said diaphragm concentric with, and at a predetermined distance from, said anode and cathode wherein said self-aligning means is a floating means or a means for a slight side-ways free movement of said diaphragm.

2. The electrolytic cell of claim 1 wherein said self-aligning means is said floating means.

3. The electrolytic cell of claim 2 wherein said floating means is a buoyancy chamber.

4. The electrolytic cell of claim 1, 2 or 3 wherein a buoyancy chamber is present at the top of the diaphragm, said buoyancy chamber causing the diaphragm assembly to float in cell electrolyte while the cell is in operation.

5. The electrolytic cell of claim 4 wherein insulating separators are present on the top of said buoyancy chamber to electrically separate said buoyancy chamber from a sodium collector position ed above said buoyancy chamber.

6. The electrolytic cell of claim 1, 2 or 3 wherein said diaphragm has a metal piece fastened to its top portion, said metal piece having a plurality of slots, and said electrolytic cell has a sodium collector mounted above said diaphragm and having a number of rods projecting therefrom that fit into said slots to position said diaphragm concentrically with the cell anode and cathode when said diaphragm is rotated to lock said rods in said slots.

7. The electrolytic cell of claim 1 wherein said self-aligning means is said means for a slight side-ways free movement of said diaphragm.

8. The electrolytic cell of claim 7 wherein said self-aligning means further comprises at least two sets of insulating roller-spacers, one of which is near the bottom of said diaphragm.

* * * * *